US010575658B2

(12) United States Patent
Romero

(10) Patent No.: US 10,575,658 B2
(45) Date of Patent: Mar. 3, 2020

(54) ADJUSTABLE CHILD RESTRAINT DEVICE

(71) Applicant: EAST BABIES, L.L.C., New Iberia, LA (US)

(72) Inventor: Amanda Nicole Romero, New Iberia, LA (US)

(73) Assignee: EAST BABIES, L.L.C., New Iberia, LA (US)

( * ) Notice: Subject to any disclaimer, the term of this patent is extended or adjusted under 35 U.S.C. 154(b) by 0 days.

(21) Appl. No.: 15/940,285

(22) Filed: Mar. 29, 2018

(65) Prior Publication Data

US 2018/0279804 A1 Oct. 4, 2018

Related U.S. Application Data

(60) Provisional application No. 62/572,202, filed on Oct. 13, 2017, provisional application No. 62/478,432, filed on Mar. 29, 2017.

(51) Int. Cl.

| | |
|---|---|
| ***A47C 7/02*** | (2006.01) |
| ***A47D 15/00*** | (2006.01) |
| ***A47D 1/02*** | (2006.01) |
| ***A47D 1/10*** | (2006.01) |

(52) U.S. Cl.

CPC ..... *A47D 15/006* (2013.01); *A47D 1/02* (2013.01); *A47D 1/10* (2013.01); *A47D 1/103* (2013.01)

(58) Field of Classification Search

CPC ..... A47D 15/006; A47D 1/103; A47D 1/10; A47D 1/02; A47D 15/005; B60N 2/0288; B60N 2/832; B60N 2/2878; B60N 2002/2896

USPC ..... 297/353, 230.14, 230.12, 230.11, 255, 297/464, 256.13, 250.1, 16.1, 230.1, 297/230.13, 452.63

See application file for complete search history.

(56) References Cited

U.S. PATENT DOCUMENTS

| | | | | |
|---|---|---|---|---|
| 1,192,798 A | | 7/1916 | Scott | |
| 1,293,592 A | | 2/1919 | Wilber et al. | |
| 1,546,768 A | | 7/1925 | West | |
| 1,814,497 A | | 7/1931 | Thompson | |
| 2,457,978 A | * | 1/1949 | Curran | A47C 1/146 297/350 |

(Continued)

FOREIGN PATENT DOCUMENTS

| | | |
|---|---|---|
| CN | 103799765 | 5/2014 |
| GB | 2245161 | 1/1992 |
| GB | 2460454 | 12/2009 |

OTHER PUBLICATIONS

PCT International Search Report and Written Opinion of the International Searching Authority for International App. No. PCT/US2018/025195, dated Jul. 29, 2018.

*Primary Examiner* — Chi Q Nguyen

(74) *Attorney, Agent, or Firm* — Garvey, Smith & Nehrbass, Patent Attorneys, L.L.C.; Seth M. Nehrbass; Julie R. Chauvin

(57) ABSTRACT

A child restraining device in the form of a folding or foldable chair includes a frame with a back. The back of the frame has parallel rods and a bottom foldably attached to the back by lockable hinges. The apparatus has upper and lower corrugated panels attached to the frame. There are a plurality of straps which fit removably through slots on the seat back and seat bottom. These straps are part of a harness that can be adjusted to the height/size of the child to be restrained.

19 Claims, 21 Drawing Sheets

(56) References Cited

U.S. PATENT DOCUMENTS 2,571,282 A 10/1951 Newton et al.
2,587,194 A 2/1952 Mitchell
2,613,724 A 10/1952 Arnold
2,663,880 A 12/1953 Meeks
2,852,066 A 9/1958 Hawkins
2,957,515 A 10/1960 Gibson
3,026,142 A 3/1962 Holloway
3,066,980 A * 12/1962 Clute ..... A47C 1/16 297/252
3,146,026 A 8/1964 Berlin
3,454,304 A 7/1969 Hudak
3,690,525 A 9/1972 Koons
4,045,834 A 9/1977 Mason
4,094,531 A * 6/1978 Cabagnero ..... B62B 7/08 280/649
4,416,462 A 11/1983 Thompson
4,793,652 A * 12/1988 Hannah ..... A61G 5/10 297/230.14
4,807,927 A 2/1989 Livick
4,865,380 A 9/1989 Heitzman-Powell et al.
4,889,383 A 12/1989 Jones
4,890,882 A 1/1990 Harrington
5,100,203 A * 3/1992 Novak ..... A47C 1/146 297/380
5,139,308 A 8/1992 Ziman
5,222,641 A 6/1993 Medeiros, Jr.
5,366,271 A 11/1994 Johnston et al.
5,395,154 A 3/1995 Wang
D372,804 S 8/1996 McNamara et al.
5,810,437 A 9/1998 Sharpe
6,164,726 A * 12/2000 Reeves ..... A47C 1/146 297/16.2
6,206,471 B1 3/2001 McGowan
6,592,187 B2 7/2003 Calvery
6,863,350 B1 3/2005 McCulley et al.
6,932,429 B2 8/2005 Kamiki
6,969,120 B2 11/2005 Levin
7,000,985 B2 2/2006 Belgarde
7,188,899 B1 3/2007 McClellan-Derrickson
8,152,236 B1 4/2012 Romero
8,262,157 B2 * 9/2012 Novak ..... A47C 1/146 297/16.2
8,517,462 B2 8/2013 Birch
8,528,976 B2 9/2013 Wimberley
8,540,312 B2 9/2013 Asbach et al.
8,627,523 B2 * 1/2014 Kaiser ..... A47C 19/022 297/230.1
9,220,344 B2 12/2015 Birch
9,226,585 B1 1/2016 Bright
2007/0035169 A1 * 2/2007 Sawyer ..... A47C 7/021 297/382
2007/0145789 A1 6/2007 Linero
2008/0018152 A1 1/2008 Vadai
2008/0036256 A1 * 2/2008 Gold ..... A47D 1/02 297/255
2008/0303328 A1 * 12/2008 Hogg ..... A61G 5/1067 297/354.13
2010/0201162 A1 * 8/2010 Leywood ..... A47C 5/005 297/16.1
2011/0169307 A1 7/2011 Asbach et al.
2012/0043793 A1 2/2012 Roden
2012/0098307 A1 4/2012 Whittington et al.
2012/0104786 A1 5/2012 Wimberley
2012/0299339 A1 11/2012 Birch
2014/0346826 A1 11/2014 Ishisako

* cited by examiner

ADJUSTABLE CHILD RESTRAINT DEVICE

CROSS-REFERENCE TO RELATED APPLICATIONS

The following related patent applications are hereby incorporated herein by reference: U.S. Provisional Patent Application Ser. Nos. 62/478,432, filed 29 Mar. 2017; and 62/572,202, filed 13 Oct. 2017; priority of these applications is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a child restraint device. More particularly, the present invention relates to a portable folding child restraint device in the form of a folding chair having a specially configured frame with a corrugated or multi-panel seat and seat back that fold the panels around the frame in a storage position.

2. General Background of the Invention

The following US patent is hereby incorporated herein by reference: U.S. Pat. No. 8,152,236.

BRIEF SUMMARY OF THE INVENTION

The present invention provides an improved apparatus for restraining a child in a specially configured folding seat. The apparatus of the present invention combines the security of a device, such as a high chair or a shopping cart seat, designed specifically to hold the intended child with the convenience of a portable child seat. Most child seats outside of the home are made to accommodate children of various sizes. Accordingly, many children can move with minimal restriction in these seats which inhibits an adult's freedom while dining, shopping, or engaging in various other activities outside of the home.

The present invention provides an apparatus which can be attached to a bench or seat and adjusted to accommodate the height and weight of the child to be restrained thus eliminating the problem of unrestricted child movement which inhibits adult freedom in a public setting.

The present invention includes a foldable child's chair including a frame that includes an upper section and a lower section. Preferably there can be a means for pivotally joining the upper section to the lower section wherein the upper section is able to rotate into a folded, storage position wherein the folded, storage position, the upper and lower sections can be generally aligned. A corrugated seat back can be attached to the upper section, the corrugated seat back including a plurality of panels that each fold upon another of the panels in the folded, storage position. A seat bottom can be attached to the lower section. In the storage position some of the panels can abut the frame.

Preferably, the panels can be each of a plastic, synthetic, wood or metal material.

Preferably, the upper section includes spaced apart frame rods and wherein the seat back spans between the upper spaced frame rods.

Preferably, the lower section includes spaced apart lower frame rods and wherein the seat bottom spans between the lower frame rods.

Preferably, a score separates each panel from another panel.

Preferably, the scores can be generally parallel.

Preferably, the present invention further comprises a first folding strut mounted to the frame upper section next to the seat back that moves between relaxed and extended positions wherein the seat back is fully expanded by the strut when the strut is in the extended position.

Preferably, the present invention further comprises a second folding strut mounted to the frame lower section next to the seat bottom that moves between relaxed and extended positions wherein the seat bottom is fully expanded by the strut when the strut is in the extended position.

Preferably, the seat bottom includes a plurality of panels that each fold upon another of the panels in a storage position.

The present invention includes a foldable child's chair including a frame that includes an upper section that includes a pair of upper rods and a lower section. First and second pivotal connections can join the upper section to the lower section wherein the upper section is able to rotate into a folded position, storage wherein the upper and lower rods are generally aligned. A seat back can be attached to the upper section. A seat bottom can be attached to the lower section. One or both of the seat back and seat bottom can include a plurality of panels, each panel folding upon one or more other of the panels in a storage position. In the storage position the first and second pivotal connections move toward each other, some of the panels can abut the frame.

Preferably, the frame upper section includes spaced apart first and second upper rods.

Preferably, the frame lower section includes spaced apart first and second lower rods.

Preferably, the seat back attaches to each of the upper rods.

Preferably, the seat bottom attaches to each of the lower rods.

Preferably, each of the pivotal connections can be lockable in a selected position of multiple positions so that the angle between the upper section and the lower section can be changed to a selected angle.

Preferably, the present invention further comprises a seat harness that enables a connection to be made between the frame lower section and a selected, underlying bench, chair or seat.

Preferably, the present invention further comprises safety belts on the seat frame that enable a child to be restrained while sitting on the seat bottom.

Preferably, the seat back has one or more seat back openings and the safety belt passes through one or more of the seat back openings.

Preferably, at least some of the rods include multiple flat sides and the panels abut multiple of the flat sides in the storage position.

The present invention includes a foldable child's chair including a frame that includes an upper section and a lower section, each section having spaced apart frame rods. First and second pivotal connections can join the upper section to the lower section, each rod can be connected to a pivotal connection, wherein the upper section is able to rotate into a folded position wherein the upper and lower sections are generally aligned. A seat back can be attached to the upper section. A seat bottom can be attached to the lower section. The seat back and seat bottom each including a plurality of panels, each panel folding upon one or more other of the panels in a storage position. In the storage position some of the panels abut the frame and the pivotal connections move toward one another. Each seat back and seat bottom can be expandable into and expanded position. Foldable and expandable locking members can enable the seat back and seat bottom to be held in the expanded position.

The present invention includes a foldable child's chair that includes a frame having an upper section and a lower section, a means for pivotally joining the upper section to the lower section wherein the upper section is able to rotate into a folded, storage position wherein the folded, storage position, the upper and lower sections are generally aligned, a corrugated seat back that is attached to the upper section, said corrugated seat back including a plurality of panels that each fold upon another of said panels in the folded, storage position, a seat bottom attached to the lower section, and wherein in said storage position some of the panels abut the frame.

The present invention includes a foldable child's chair that includes a frame including an upper section that includes a pair of upper rods and a lower section, first and second pivotal connections that join the upper section to the lower section wherein the upper section is able to rotate into a folded storage position, wherein the upper and lower rods are generally aligned, a seat back that is attached to the upper section, a seat bottom that is attached to the lower section, one or both of said seat back and seat bottom including a plurality of panels, each said panel folding upon one or more other of said panels in a storage position, and wherein in said storage position, the first and second pivotal connections move toward each other, some of the panels abut the frame.

The present invention includes a foldable child's chair, including a frame that includes an upper section and a lower section, each section having spaced apart frame rods; first and second pivotal connections that join the upper section to the lower section, each rod connected to a said pivotal connection, wherein the upper section is able to rotate into a folded position wherein the upper and lower sections are generally aligned; a seat back that is attached to the upper section; a seat bottom that is attached to the lower section; the seat back and seat bottom each including a plurality of panels, each said panel folding upon one or more other of said panels in a storage position; wherein in said storage position some of the panels abut the frame and the pivotal connections move toward one another; each seat back and seat bottom being expandable into an expanded position; and foldable and expandable locking members that enable the seat back and seat bottom to be held in the expanded position.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
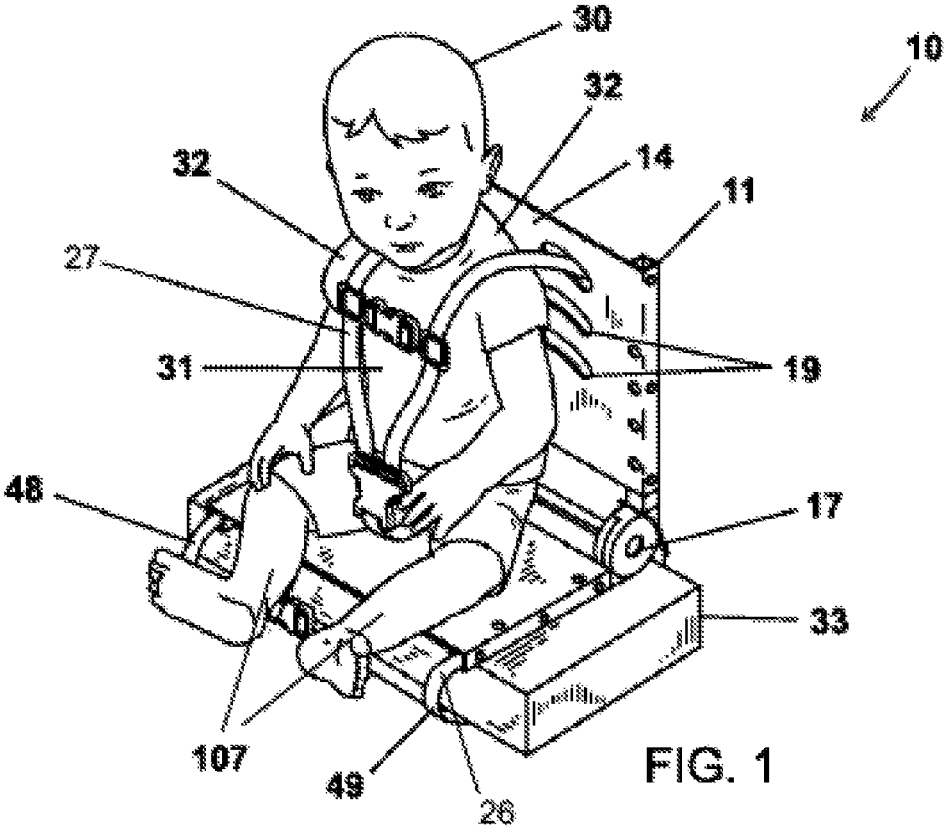
FIG. 1 shows a perspective view of a preferred embodiment of the apparatus of the present invention restraining a child.

The apparatus of the present invention provides a child's foldable or folding seat 10 or restraining device that can be easily attached to an underlying support such as a bench, chair or the like. The seat 10 provides a frame 11 that preferably includes an upper frame section 12 and lower frame section 13. Upper section 12 preferably includes seat back 14. Lower section 13 preferably includes seat bottom 15. Each of the seat back 14 and seat bottom 15 can be provided with a cover 28, 29. The seat back 14 has seat back cover 28. The lower frame section 13 has seat bottom cover 29.

A pair of spaced apart locking pivots or rotary connectors 16, 17 are preferably used to pivotally attach the upper frame section 12 to the lower frame section 13. In the expanded operating position of FIGS. 1-4, these locking pivots or rotary connectors 16, 17 are preferably spaced apart. Each pivot or rotary connection 16, 17 preferably includes an outer pivot section 100 which can be a part of an upper frame leg or rod 34, 35 and an inner pivot section 105 that can be a part of or connected to a lower frame rod or leg 36, 37. Each pivot or rotary connection 16, 17 can also include a release button 90 and inner spring 98. When button 90 is depressed, it preferably compresses spring 98 and enables one pivot section 100 to rotate relative to the other section 105. The parts 100, 105 can preferably interlock together at annular projection or portion 104 registering in annular recess 106.

Slots or openings 18, 19 are preferably provided in the seat back 14. One or more slots or openings 20 are preferably provided in the seat bottom 15. Seat back cover 28 can have openings that correspond in size and shape to openings 18, 19 in seat back 14. Similarly, seat bottom cover 29 can have openings that correspond in size and shape to openings 20.

The upper frame section 12 preferably includes seat back 14 and a pair of spaced apart upper frame rods 34, 35. Similarly, the lower frame section 13 preferably includes seat bottom 15 and a pair of lower frame rods 36, 37. Rivets or other fasteners can be used to secure seat back 14 to rods 34, 35 and to secure seat bottom 15 to rods 36, 37.

Pegs 21, 22 can be provided on the rods 34, 35, 36, 37. Each of the covers 28, 29 can be provided with openings or slots 23 for enabling a connection to be made between the selected seat back cover 28 or seat bottom cover 29 with pegs 21 or 22. Such pegs 21, 22 can be provided on selected ones of the upper frame rods 34, 35 or the lower frame rods 36, 37 as seen in FIGS. 1-9.

Figure 17:
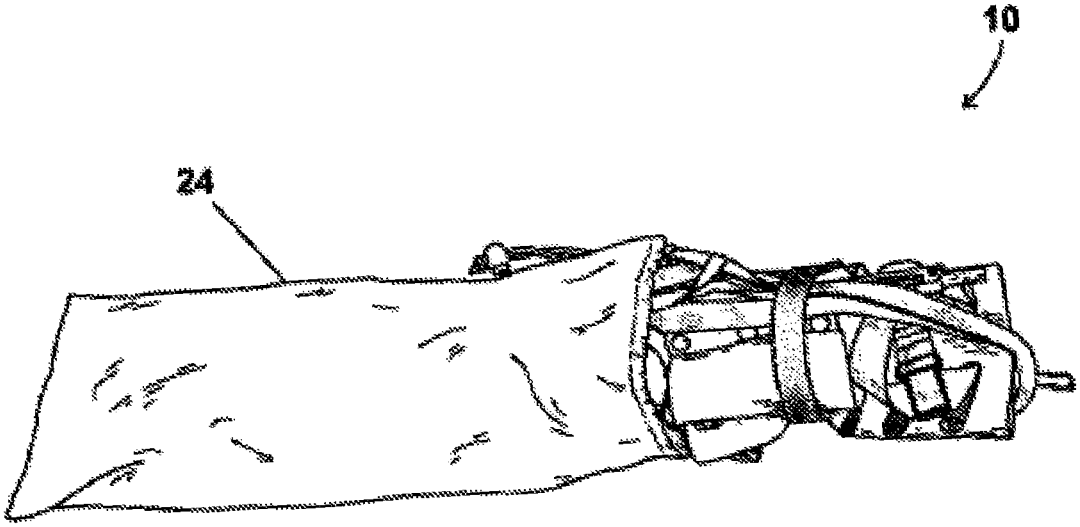
FIG. 17 shows a perspective view of a preferred embodiment of the apparatus of the present invention in a folder position and being inserted in a storage bag.
Figure 18:
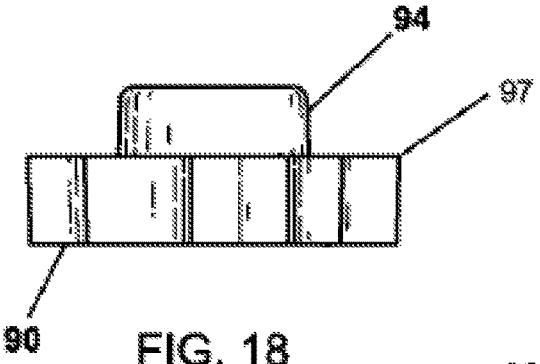
FIGS. 18-22 are fragmentary views showing a preferred embodiment of an adjustment knob of the present invention that enables adjustment of the angle between seat and seat back.
Figure 19:
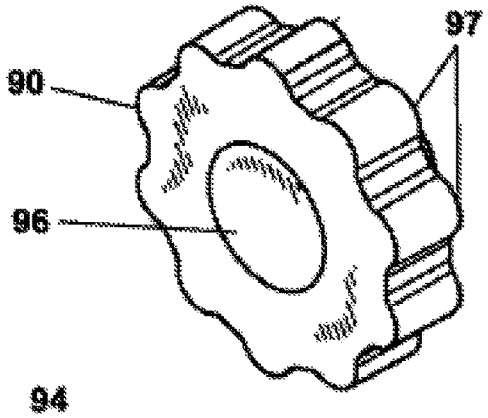
Figure 20:
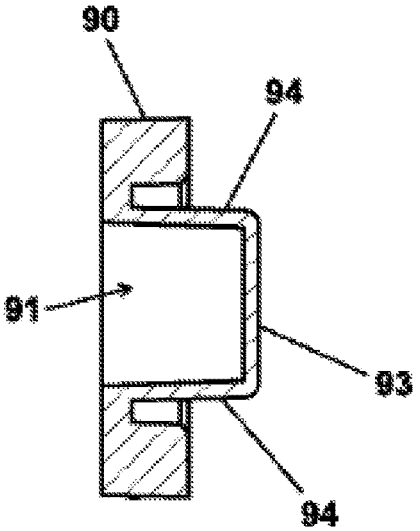
Figure 21:
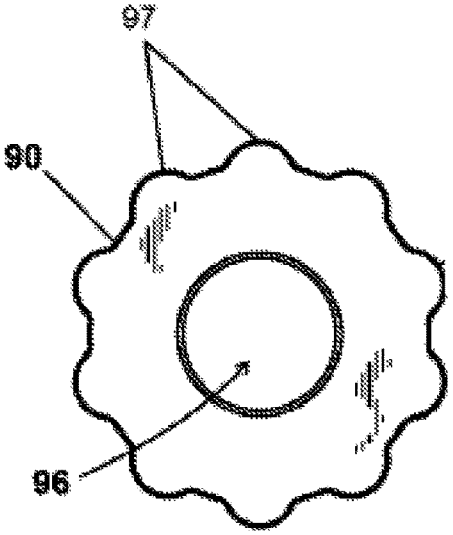
Figure 22:
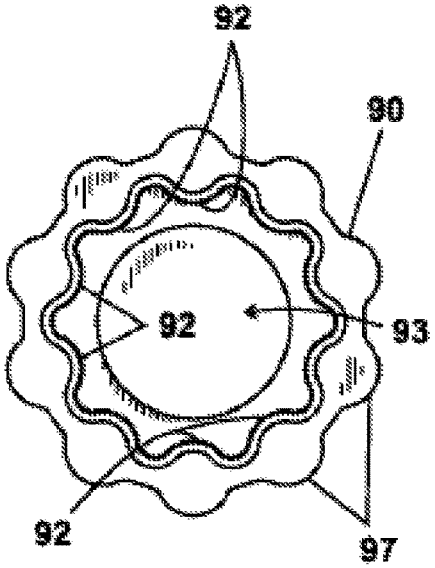
Figure 23:
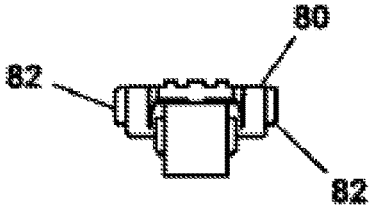
FIGS. 23-27 are fragmentary views of a preferred embodiment of one of the locking arms of the present invention.
Figure 24:
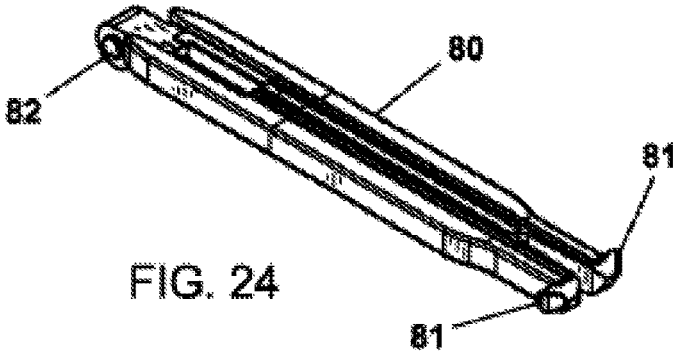
Figure 25:
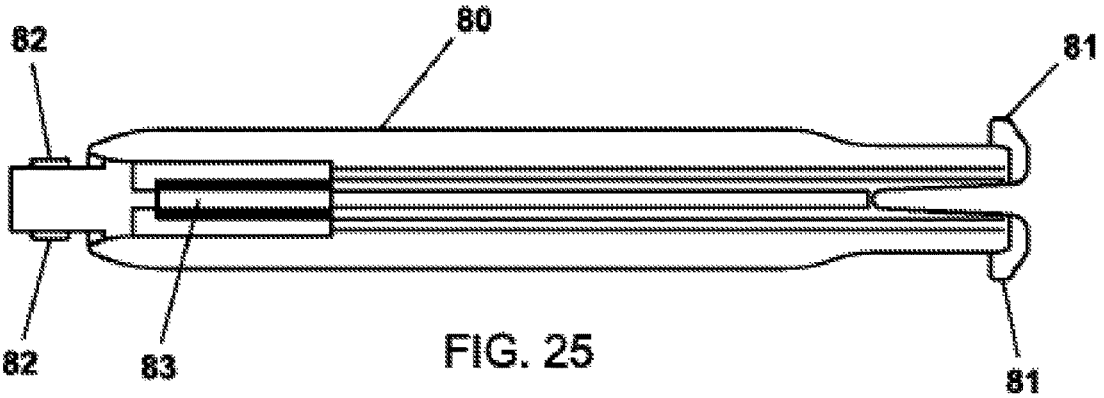
Figure 26:
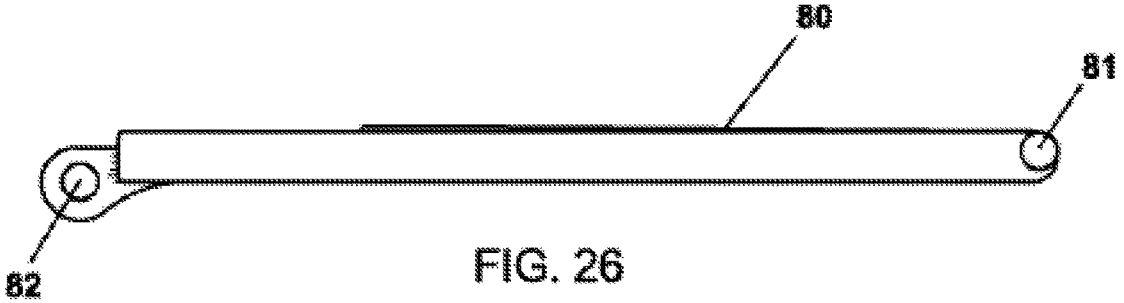
Figure 27:
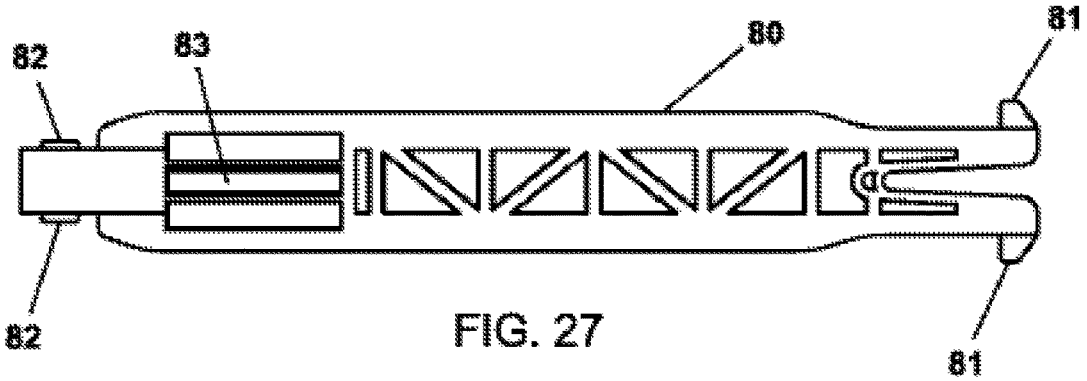
Figure 28:
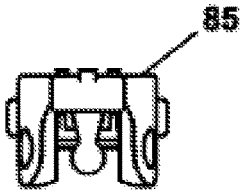
FIGS. 28-32 are fragmentary views of a preferred embodiment of the other of the locking arms of the present invention.
Figure 29:
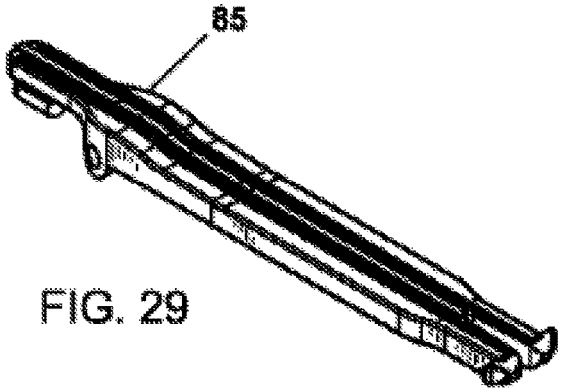
Figure 30:
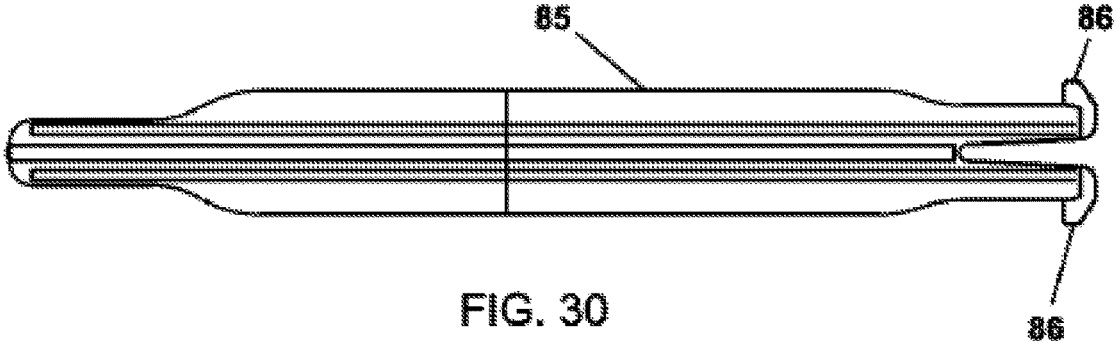
Figure 31:
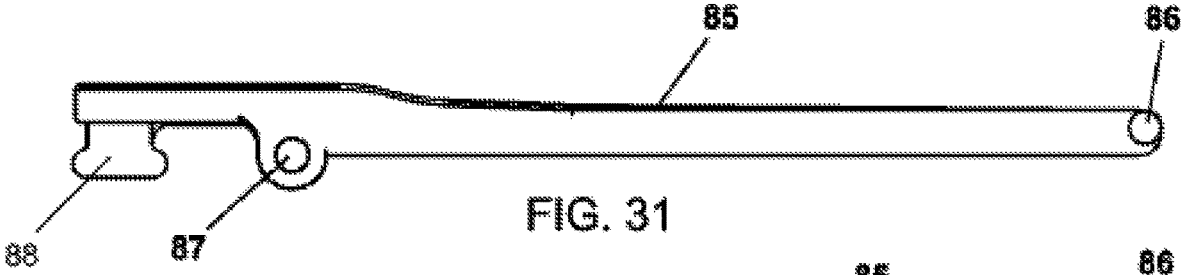
Figure 32:
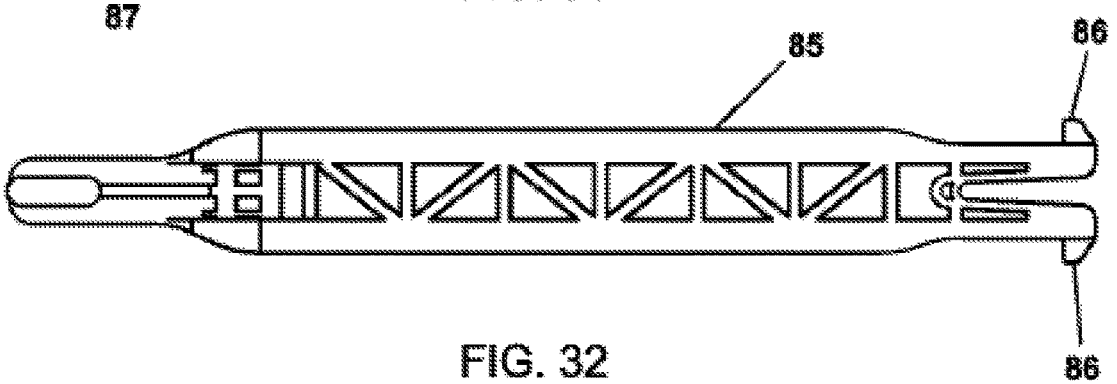
Figure 33:
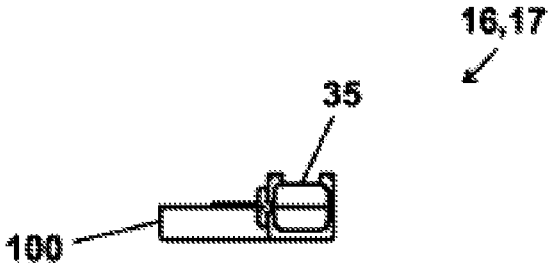
FIGS. 33-37 are fragmentary views showing a preferred embodiment of a part of the angle adjuster of the present invention.
Figure 34:
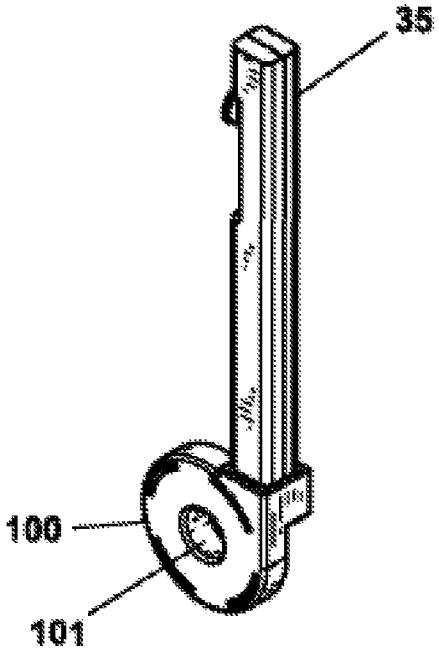
Figure 35:
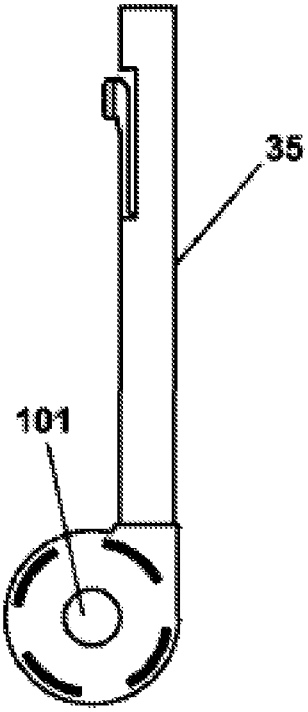
Figure 36:
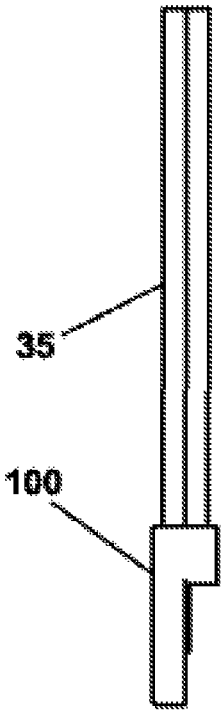
Figure 37:
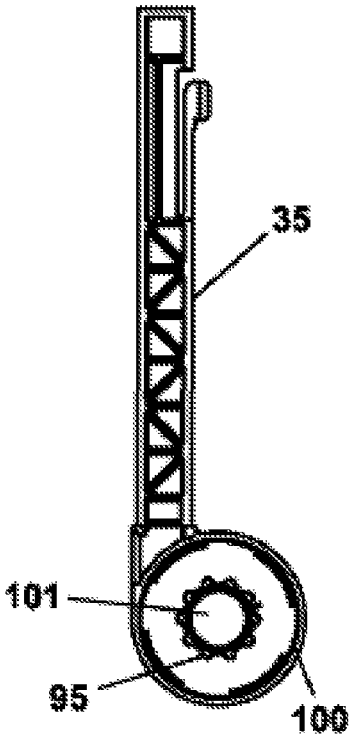
Figure 38:
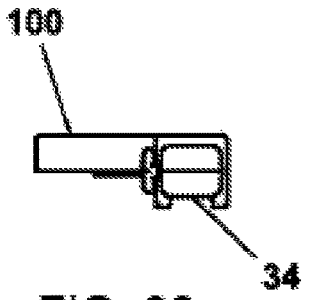
FIGS. 38-42 are fragmentary views showing a preferred embodiment of a part of the angle adjuster of the present invention.
Figure 39:
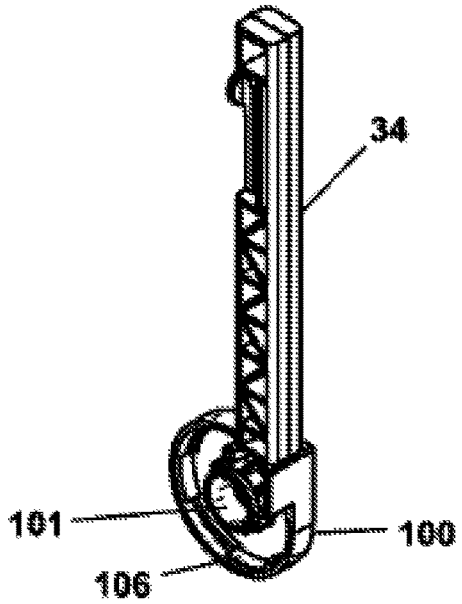
Figure 40:
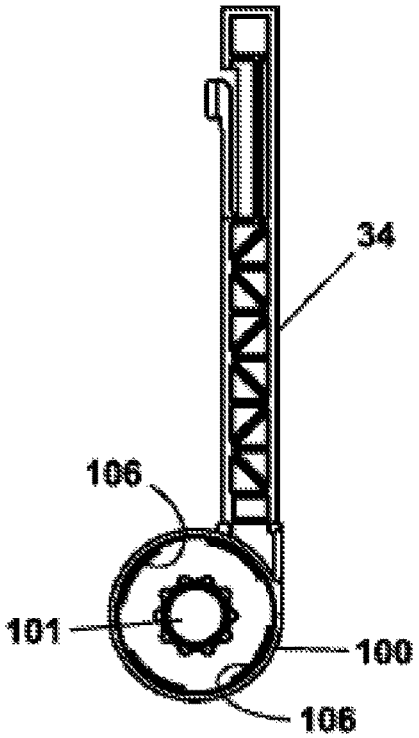
Figure 41:
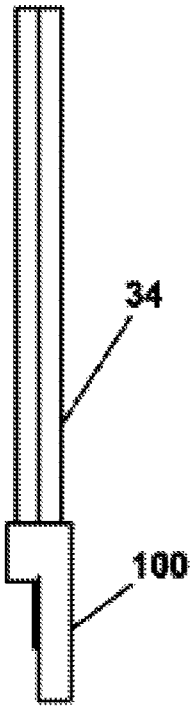
Figure 42:
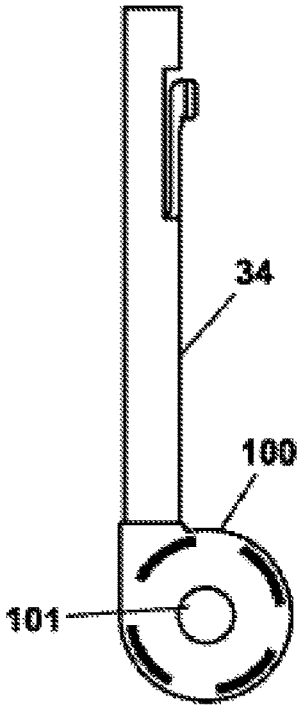
Figure 43:
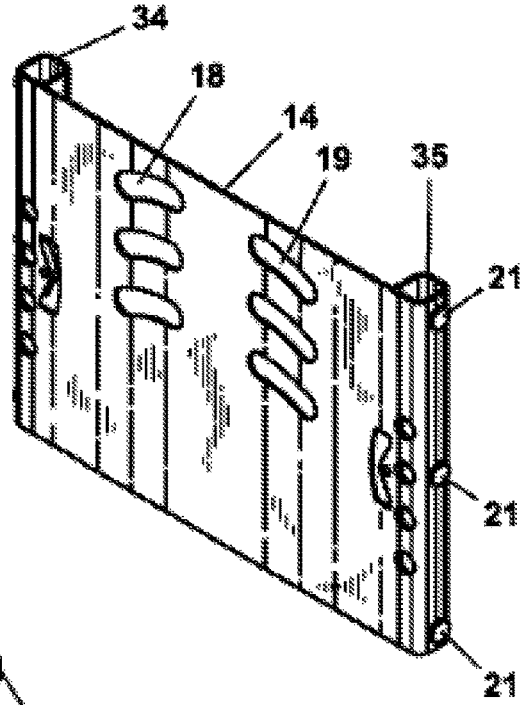
FIGS. 43-46 are various views showing a preferred embodiment of the seat back section of the present invention.
Figure 44:
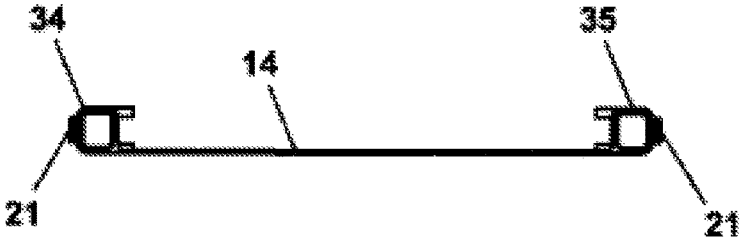
Figure 45:
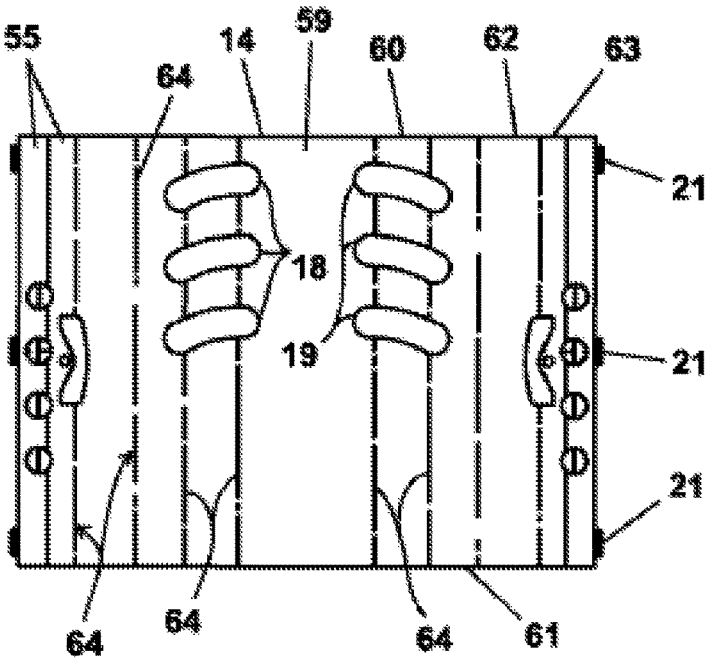
Figure 46:
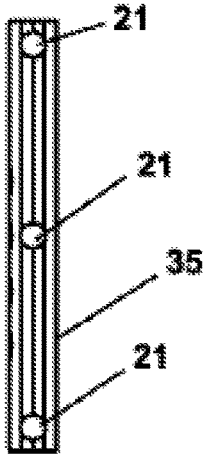
Figure 47:
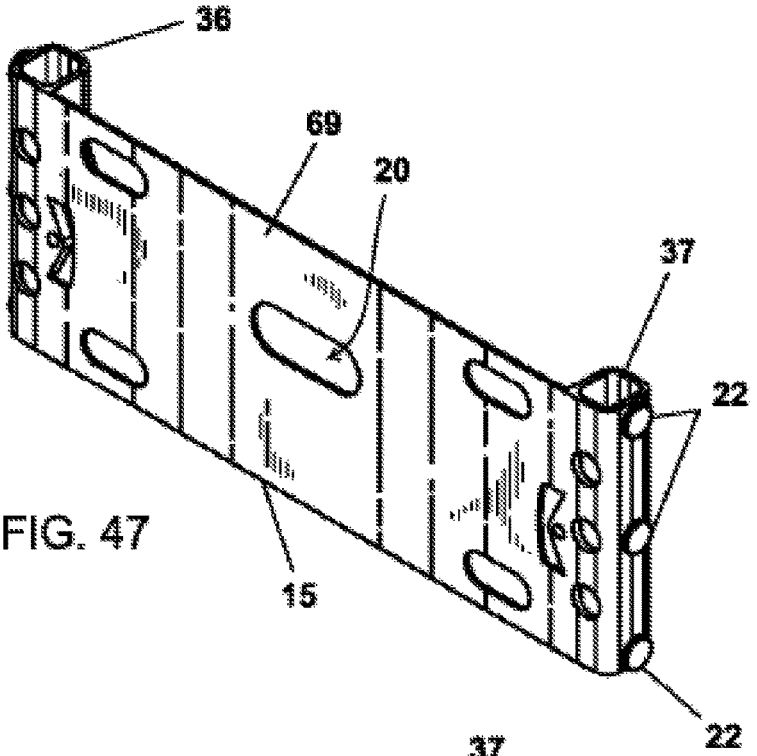
FIGS. 47-50 are various views showing a preferred embodiment of the seat bottom section of the present invention.
Figure 48:
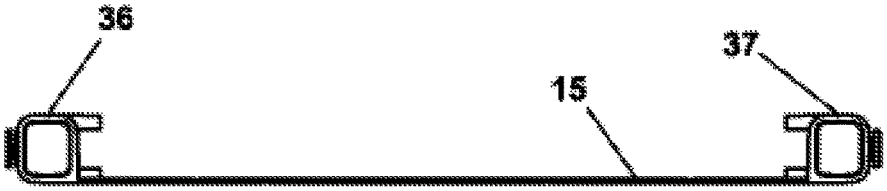
Figure 61:
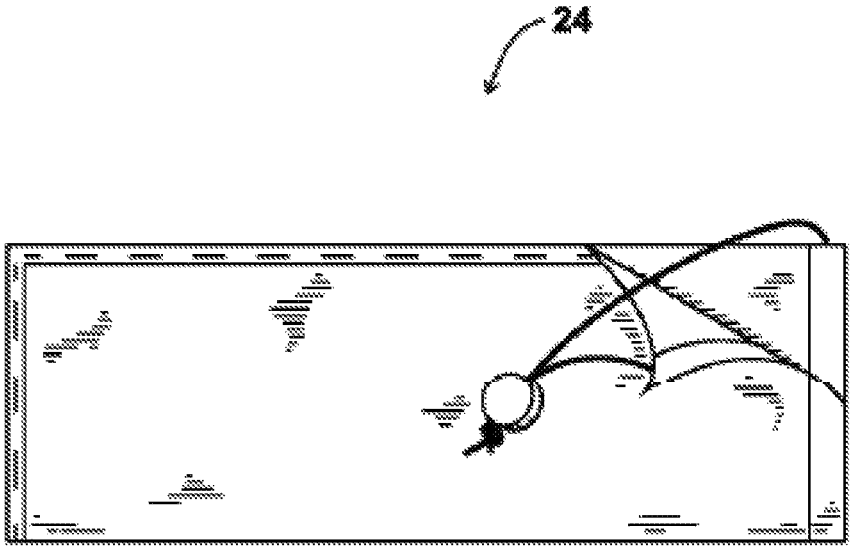
FIG. 61 is a preferred embodiment of the storage bag of the apparatus of the present invention.
Figure 62:
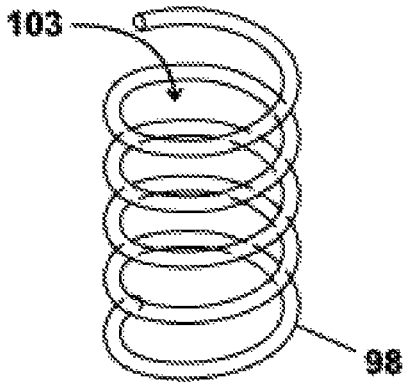
FIGS. 62-65 are various views of a preferred embodiment of the spring part of the present invention.
Figure 63:
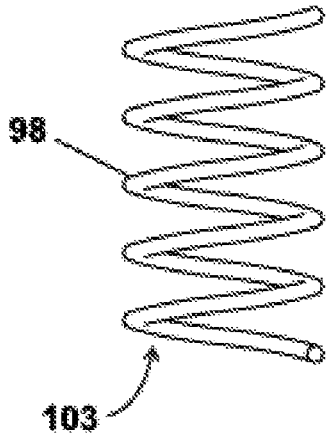
Figure 64:
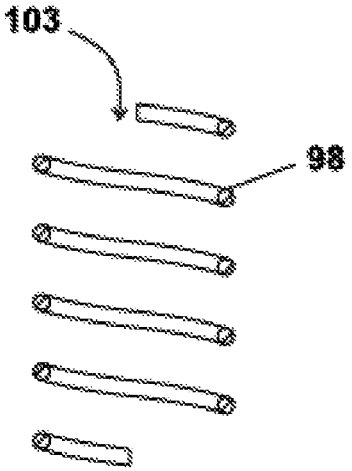
Figure 65:
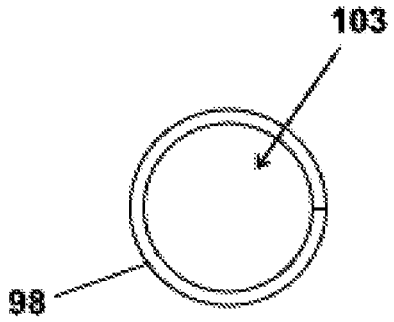
Figure 66:
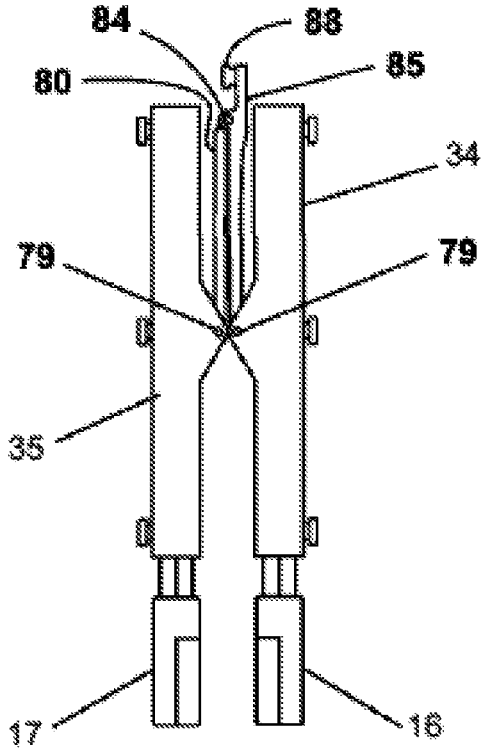
FIG. 66 shows a partial rear view of a preferred embodiment of the apparatus of the present invention in a collapsed position.

Seat 10 of the present invention preferably folds into a small bundle so that it can be placed in storage bag 24 as seen in FIGS. 17, 61. Arrows 25 illustrate the rotation of upper frame section 12 relative to lower frame section 13 when the apparatus 10 is moved to a folded or storage position (see FIGS. 8, 10 and 11). Notice when in the folded or storage position that the upper frame rods 34, 35 align with the lower frame rods 36, 37. Seat back 14 and seat bottom 15 are both preferably corrugated, each preferably comprised of multiple panels that connect to each other at scores 64 or hinges or thin sections. Seat back 14 can have preferably nine (9) panels 55-63. Panel 59 is a wider panel that enables a folding of the panels 55-63 relative to each other and/or frame rods 34, 35 as seen in FIGS. 10-15. Panel 55 can be a part of rod 34 (e.g., extruded plastic). Similarly, panel 63 can be a part of rod 35 (e.g., extruded plastic).

When folded, panels 58, 60 preferably form an angle of about ninety degrees (90°) with panel 59. Panel 57 folds to a position where it preferably abuts and contacts panel 56 as well as leg 34. Similarly, panel 61 folds to a position where it preferably abuts and contacts panel 60 as well as rod or leg 35. Panel 62 folds upon panel 63 and rod or leg 35. Similarly, panel 56 folds upon panel 55 and rod or leg 34. This folded configuration of the panels 55-63 and legs or rods 34, 35 can be seen in FIGS. 12-15.

Seat bottom 15 preferably folds in the same fashion as seat back 14. Seat bottom 15 has panels (e.g., nine (9) panels) and scores like seat back 14 (see FIGS. 6, 9-11, 47 and 49). Seat bottom 15 can thus provide seat panels 65-73 with scores 74 between adjacent panels as seen in FIGS. 6, 9-15. Seat bottom 15 folds to and around rods or legs 36, 37 in the manner shown in FIGS. 10-15.

The apparatus 10 preferably provides a seat harness 26 for attaching the apparatus 10 to a selected bench or chair. The apparatus 10 also preferably provides a child's harness 27 that is used for securing a toddler or child to the frame 11 and covers 28, 29. In the drawings, a child or toddler 30 is shown having legs 107, torso 31, and shoulders 32. The seat harness 26 is fitted to the frame 11 for holding the child's folding seat 10 to an underlying support such as a bench or chair. The child harness 27 is used for securing the child or toddler 30 to the frame 11, frame sections 12, 13 and seat back 14 and seat bottom 15.

Child harness 27 preferably has a center strap 38, connector or fitting 39, and straps 40, 41. The strap 38 and the straps 40, 41 preferably connect to the fitting 39. Buckle parts 42, 43, 44 and 45 can be provided on harness 27 as shown. The buckle parts 43, 44 form a releasable connection with buckle part 42. Buckle 45 can connect to straps 40, 41 at the child's torso 31. In the drawings, the center strap 38 can be seen going in between the legs 107 of the child 30. When the child 30 is in a user's position sitting upon seat bottom 15 and cover 29 and leaning against seat back 14 and cover 28, adjustment fittings 46, 47 enable the length of the straps 40, 41 to be changed so that straps 40, 41 preferably fit snugly against the shoulders 32 and torso 31 of the child 30 as seen in FIG. 1.

Figure 2:
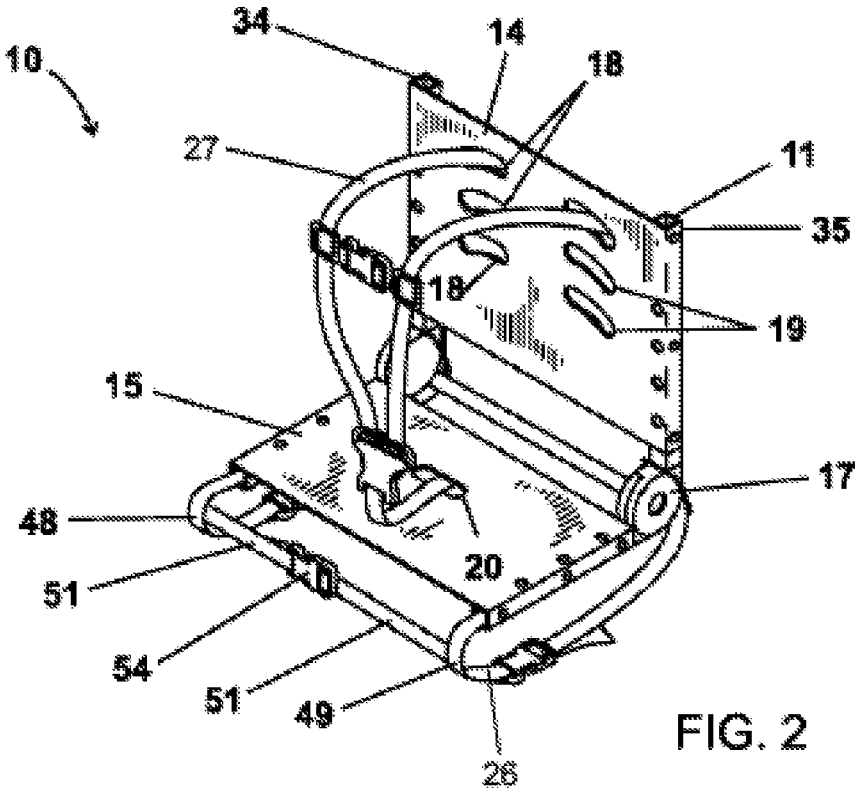
FIGS. 2-4 show a perspective view of a preferred embodiment of the apparatus of the present invention.
Figure 3:
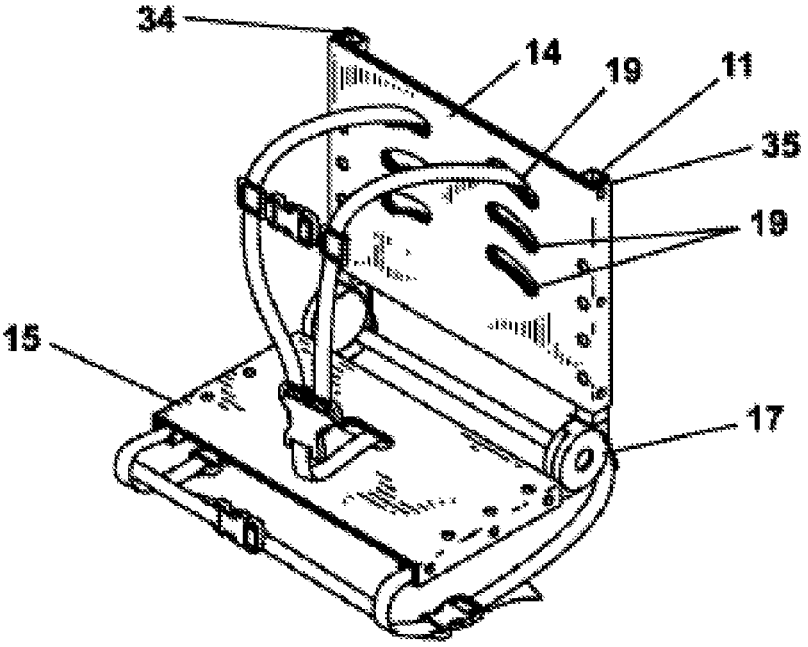
Figure 4:
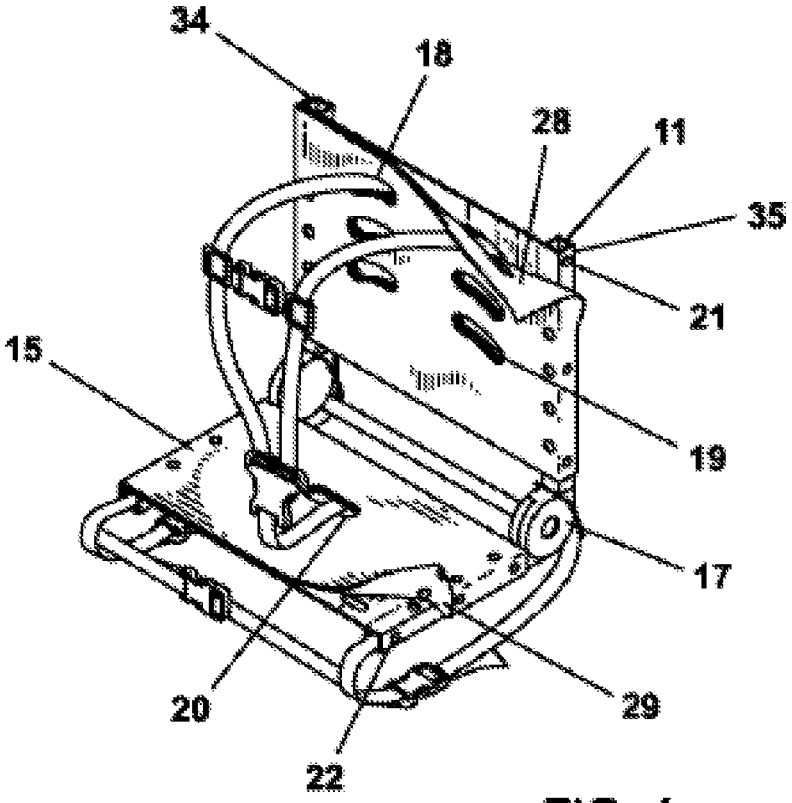
Figure 5:
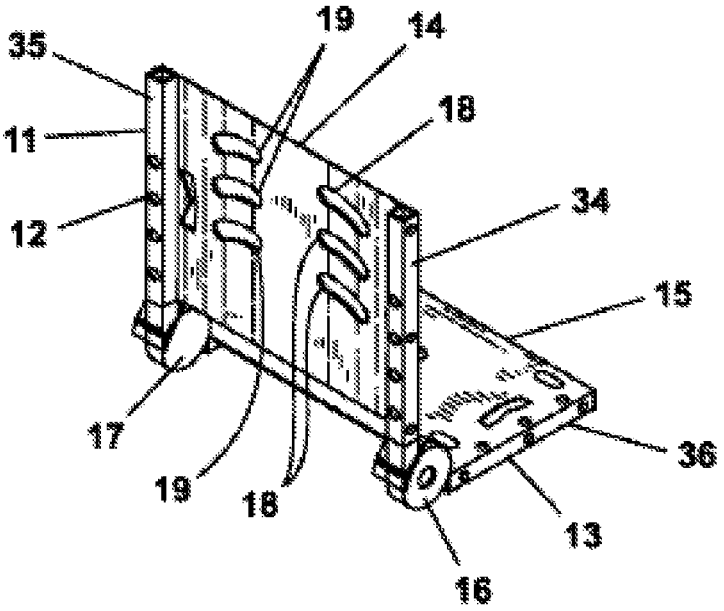
FIG. 5 shows a perspective view of a preferred embodiment of the apparatus of the present invention.
Figure 6:
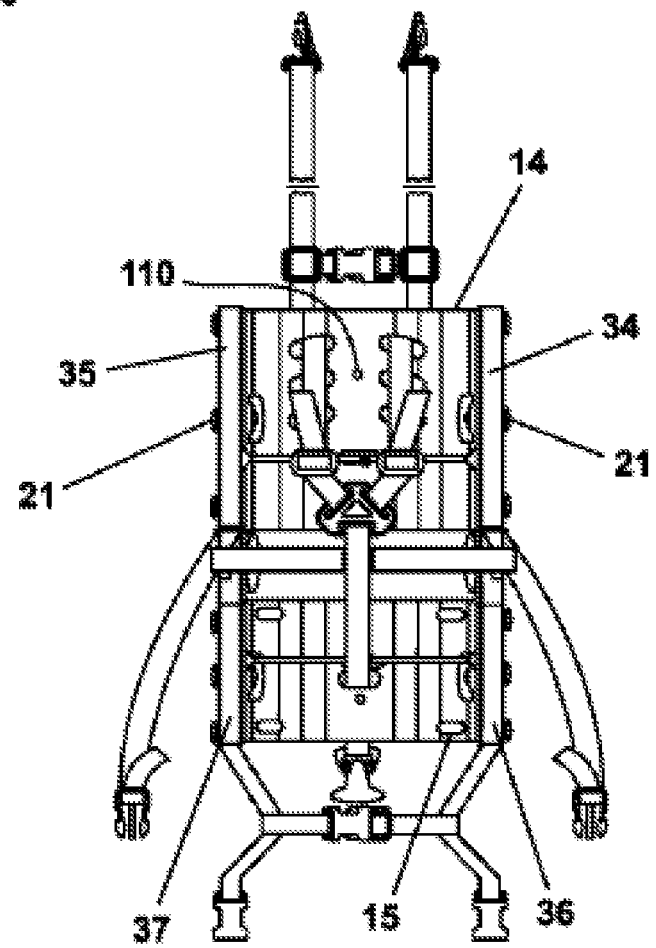
FIG. 6 shows a rear view of the adjustable frame of a preferred embodiment of the apparatus of the present invention.
Figure 7:
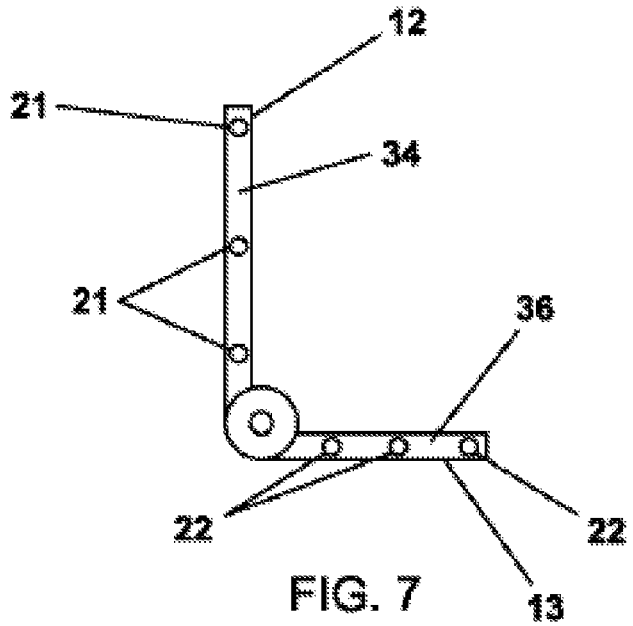
FIG. 7 shows a partial side view of a preferred embodiment of the apparatus of the present invention.
Figure 8:
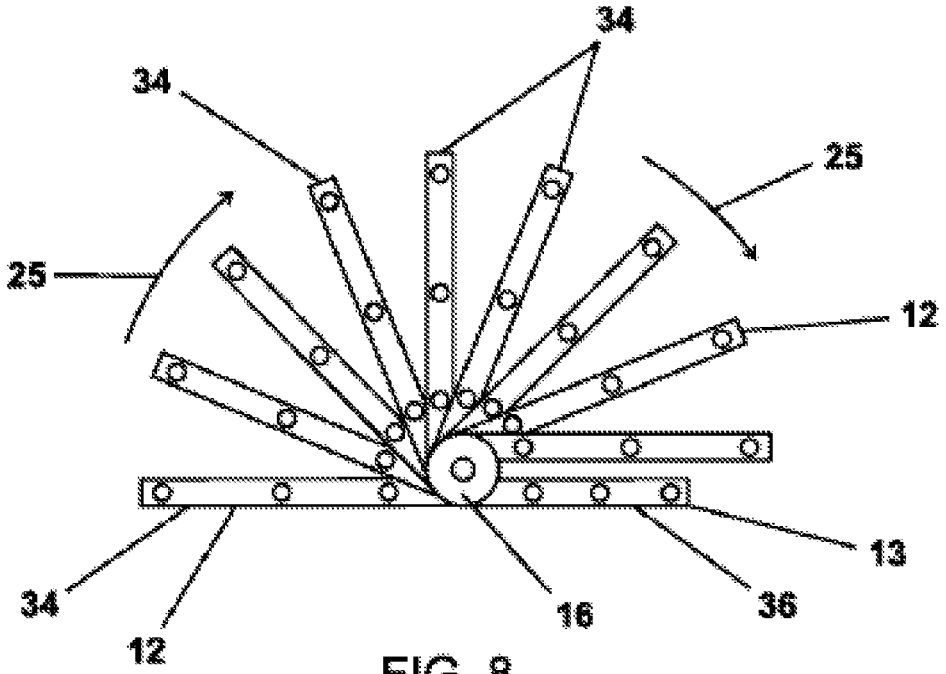
FIG. 8 shows a partial side view of a preferred embodiment of the apparatus of the present invention.
Figure 9:
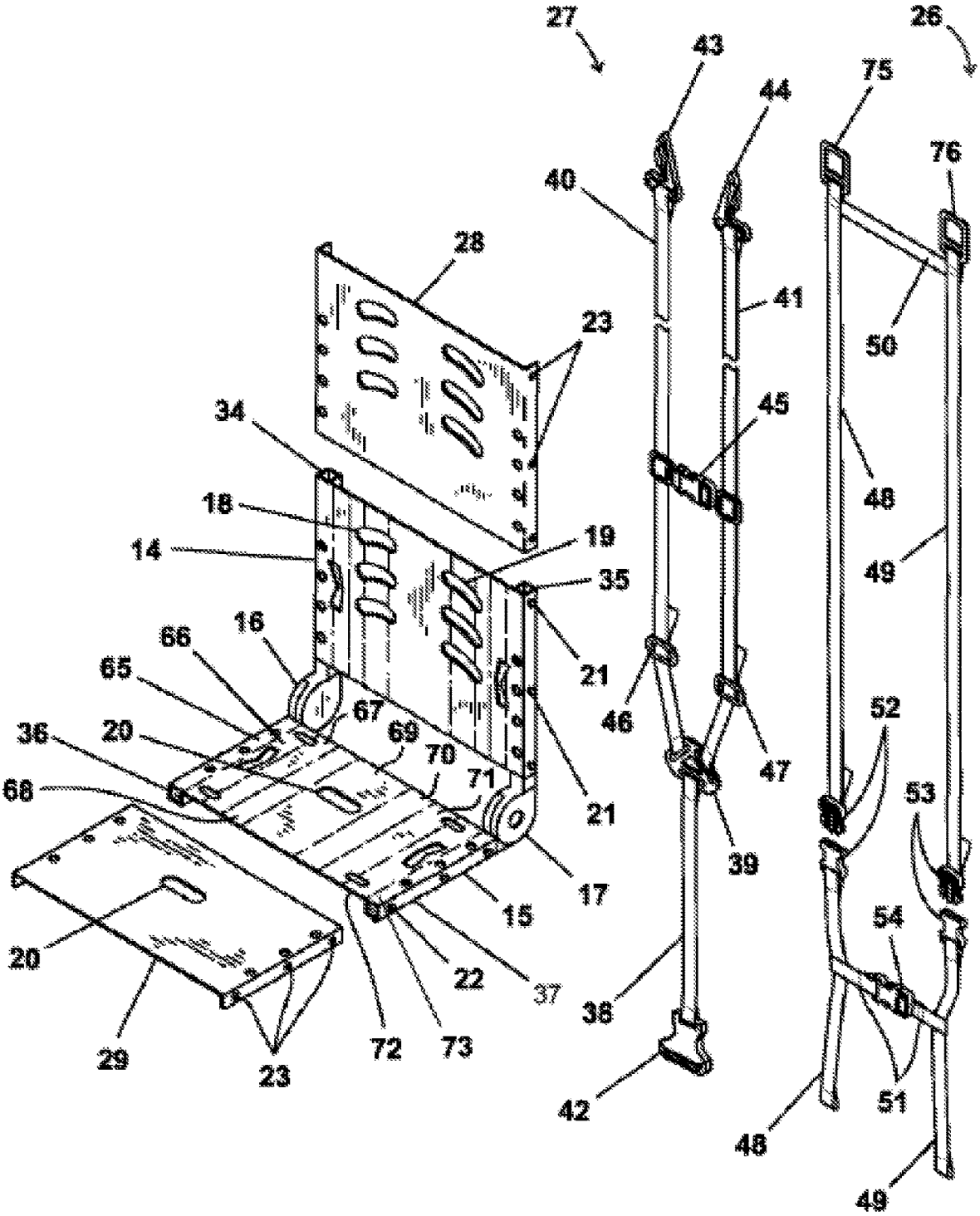
FIG. 9 shows an exploded perspective view of a preferred embodiment of the apparatus of the present invention.
Figure 10:
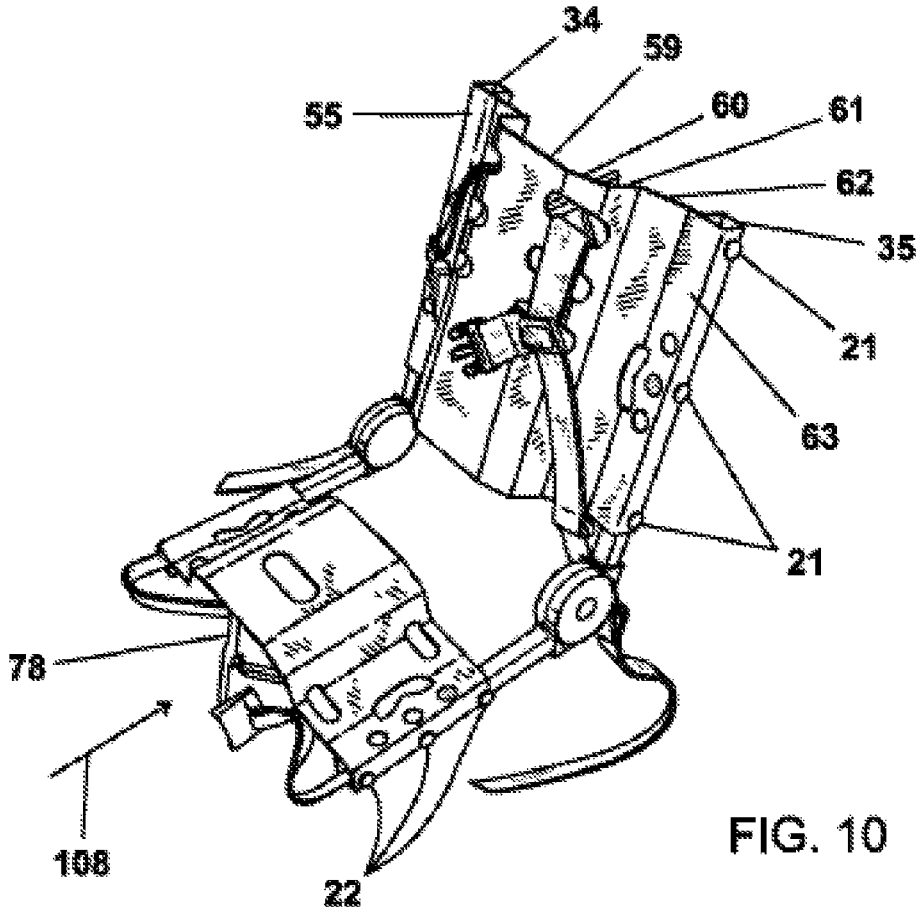
FIG. 10 shows a front perspective view of a preferred embodiment of the apparatus of the present invention in a partially folded position.
Figure 11:
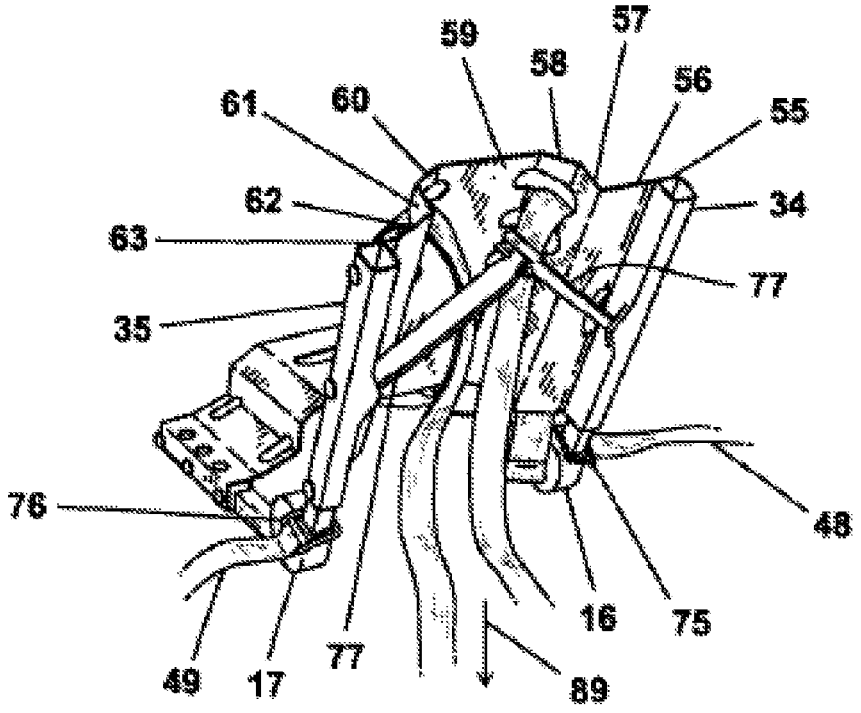
FIG. 11 shows a rear perspective view of a preferred embodiment of the apparatus of the present invention in a partially folded position.
Figure 12:
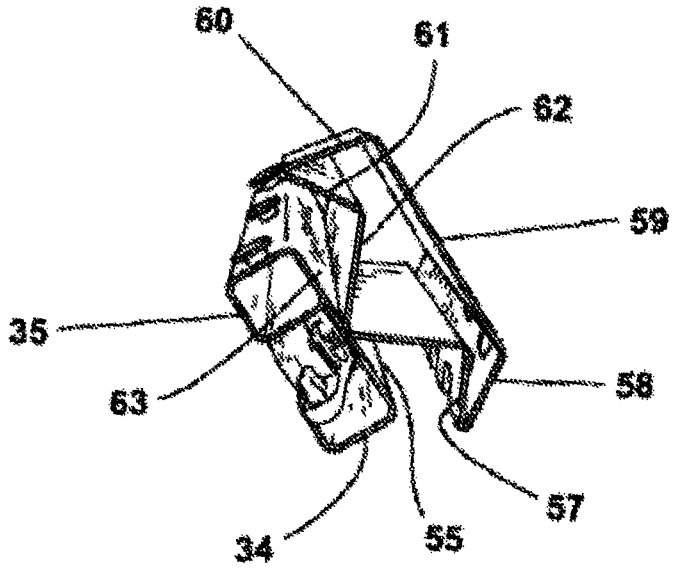
FIG. 12 is a partial perspective view of a preferred embodiment of the apparatus of the present invention in a partially folded position.
Figure 13:
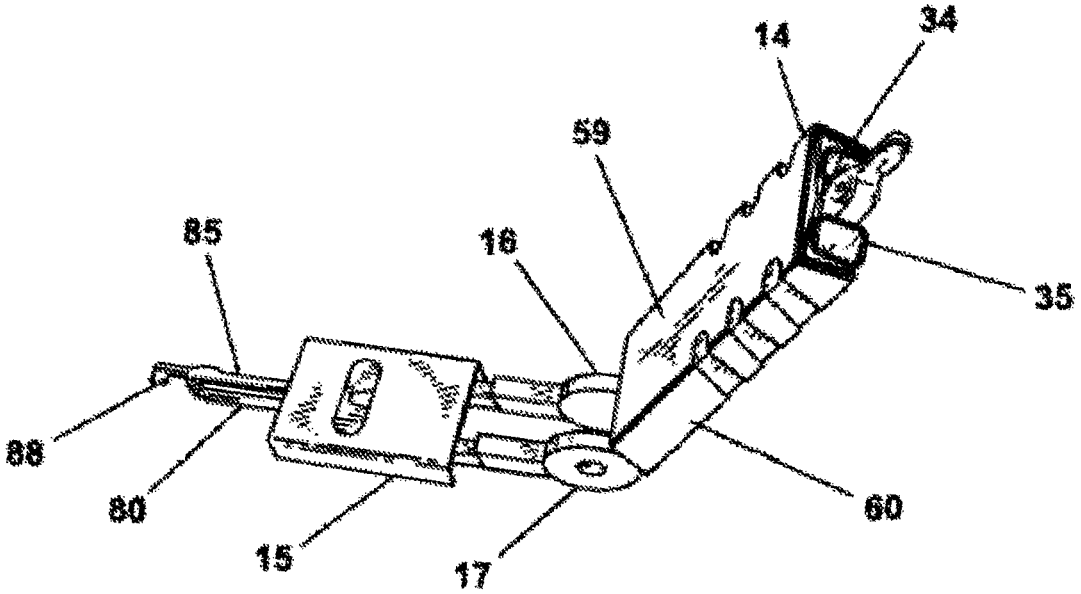
FIG. 13 is a partial perspective view of a preferred embodiment of the apparatus of the present invention in a partially folded position.
Figure 14:
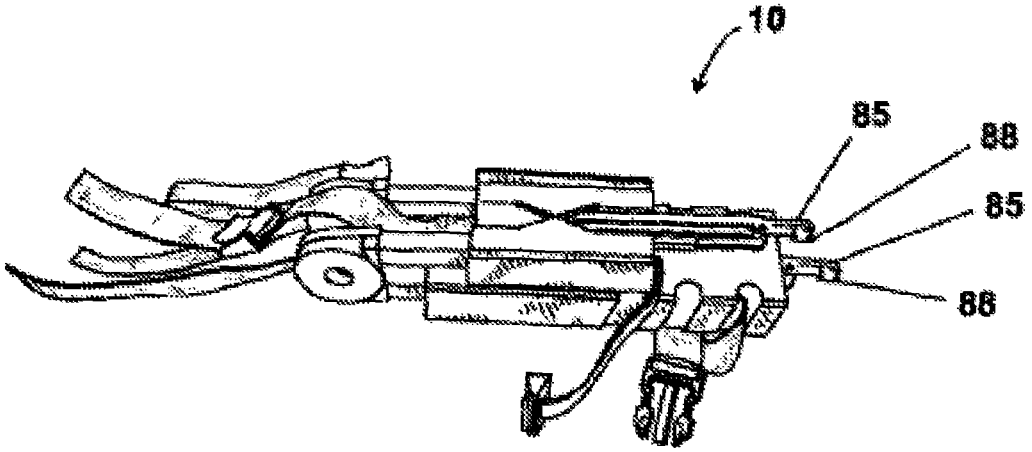
FIG. 14 shows a partial perspective view of a preferred embodiment of the apparatus of the present invention.
Figure 15:
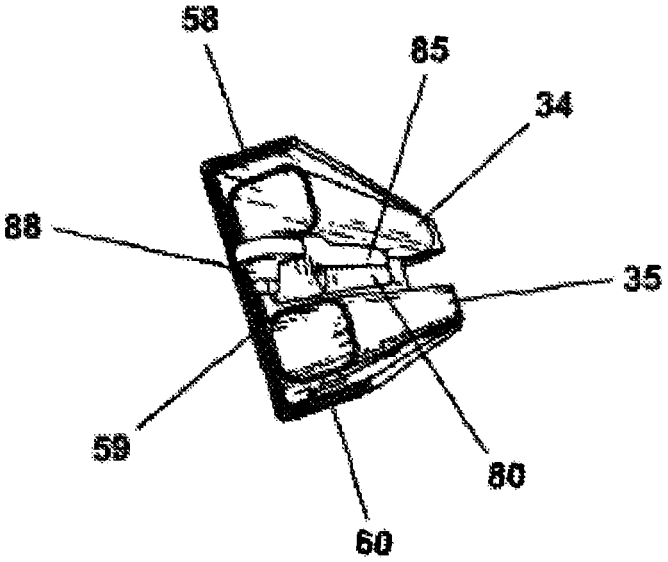
FIG. 15 is a partial end view of a preferred embodiment of the apparatus of the present invention in a folded position.

Seat harness 26 preferably has straps 48, 49, cross straps 50, 51 and buckles 52, 53, 54. Seat harness 26 can be used to secure the apparatus 10 to a bench 33, chair or other rugged support. Straps 48 and 49 each preferably connect at one end portion to rod 36 or 37 and at the other end portion to the lower end of a rod 34 or 35 using loops 75, 76. In FIGS. 1-2, strap 48 connects to the front end of rod 36 while strap 49 connects to the front end of rod 37. Loop 75 encircles the lower end of rod 34 as seen in FIG. 11. Similarly, loop 76 encircles the lower end of rod 35. After unbuckling buckles 52, 53 the straps 48, 49 can encircle a bench 33 with cross straps 51 and buckle 54 maintaining a desired spacing between the straps 48, 49.

Locking mechanisms are preferably provided for holding seat back 14 and seat bottom 15 in the expanded position of FIGS. 1-6 and 9. The locking mechanisms include an upper locking mechanism 77 for locking seat back 14 in the position of FIGS. 1-6 and 9 and lower locking mechanism 78 for locking seat bottom 15 in the position of FIGS. 1-6 and 9. Each locking member is preferably comprised of two struts or members that are pivotally connected together at inner end portions. Each locking member is pivotally attached to an upper rod or leg 34 or 35. The locking members have interlocking portions that connect to hold the locking members in an expanded, locking position.

Figure 67:
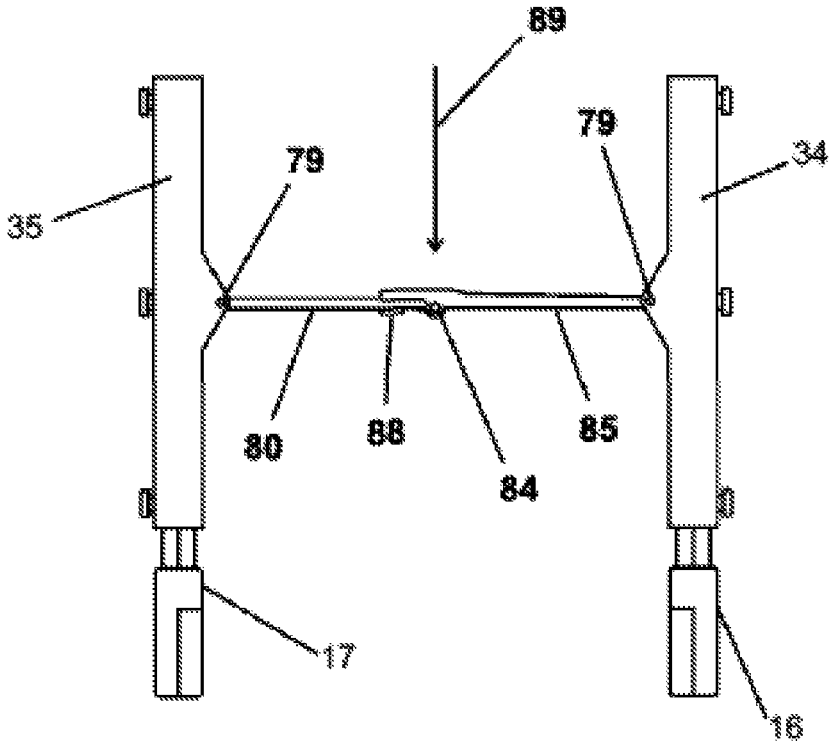
FIG. 67 is a partial rear view of a preferred embodiment of the apparatus of the present invention in an expanded position.

In FIGS. 23-27, locking member 80 has pivots 81 that attach to provided openings 79 in rod 35. In FIGS. 28-32 locking member 85 pivotally connects to rod 34 with pivots 86 attaching to openings 79. Locking members 80, 85 connect at a pivotal connection 84 wherein pivot 82 of locking member 80 connects to openings 87 of locking member 85. Projection 88 on locking member 85 interlocks with member 80 at slot 83 when the members 80, 85 are moved downwardly (see arrow 89, FIGS. 11, 67) which defines an extended, locking position. Lower locking mechanism 78 functions as does upper locking mechanism 77 wherein the locking members 80, 85 are rotated towards seat back 14 and the rear portion of the apparatus 10 (arrow 108 in FIG. 10).

The locking pivotal connections or rotary connections 16, 17 can each use a release button 90 adjacent to the socket 91, 96 (FIGS. 18-22, 33-37) that, when depressed, releases inner teeth 92 from teeth 95 of outer pivot section 100. Outer pivot section 100 has opening 101 that is receptive of projection or projecting part 94 of button 90. Button 90 has external teeth 97. When button 90 is depressed by applying pressure to surface 93, spring 98 is compressed. Button 90 moves inwardly toward inner pivot section 105. This inward movement of button 90 disengages inner teeth 92 of button 90 from the teeth 95 of outer pivot section 100. This inward movement of button 90 engages external teeth 97 of button 90 with internal teeth 99 of inner pivot section 105 as button 90 registers into recess 106. Spring 98 has a central portion 103 that registers with projection 102 of inner pivot section 105. When button 90 is depressed at surface 93, the teeth 92 and teeth 95 become offset so that one rod/leg 34, 35 can rotate relative to the other rod/legs 36, 37.

Figure 49:
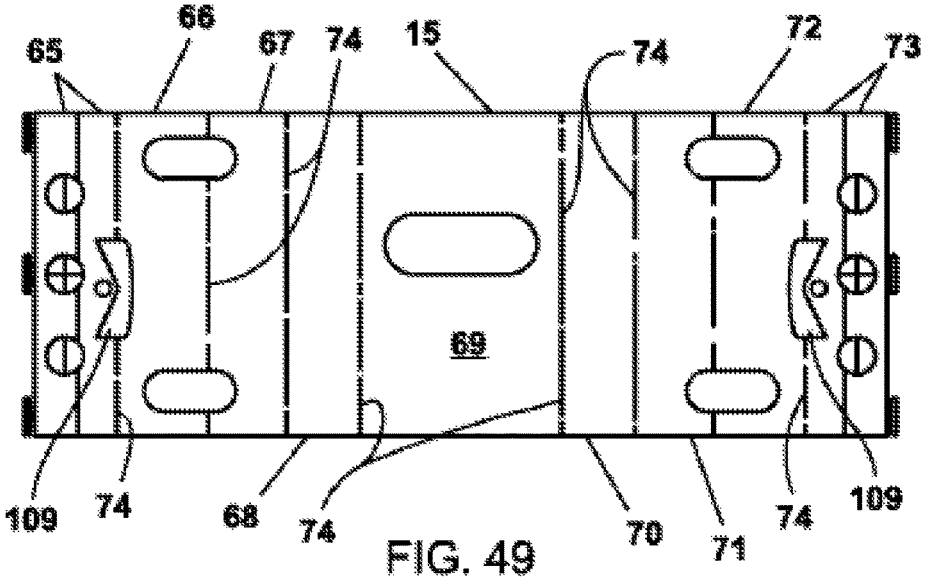
Figure 50:
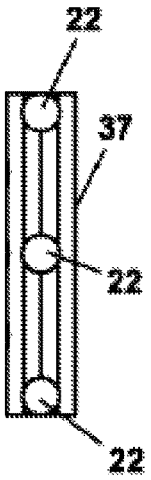
Figure 51:
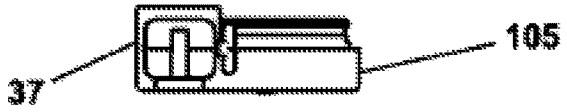
FIGS. 51-55 are various views of a preferred embodiment of a part of the angle adjuster of the present invention.
Figure 52:
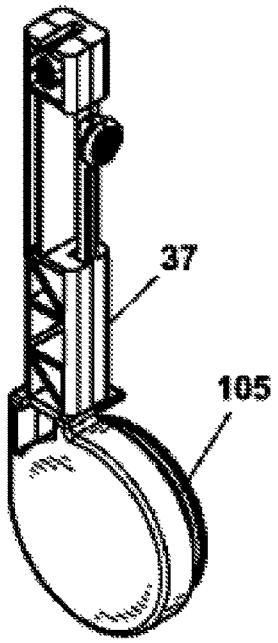
Figure 53:
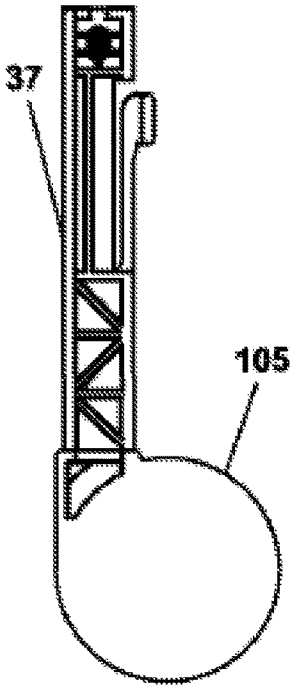
Figure 54:
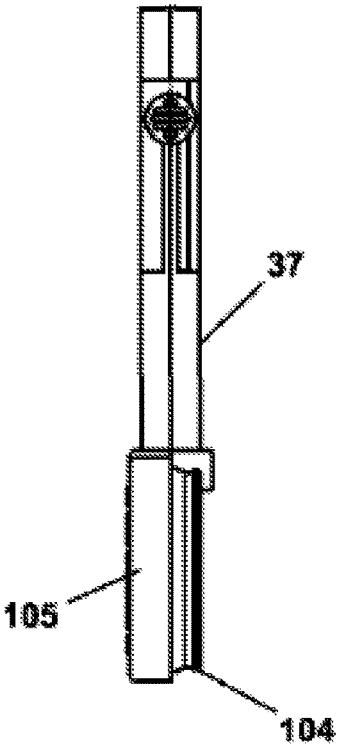
Figure 55:
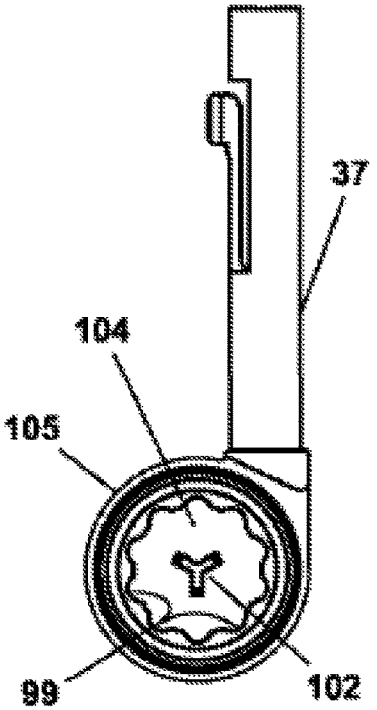
Figure 56:
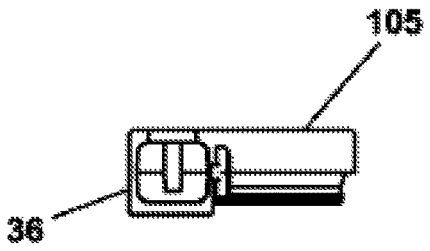
FIGS. 56-60 are various views of a preferred embodiment of a part of the angle adjuster of the present invention.
Figure 57:
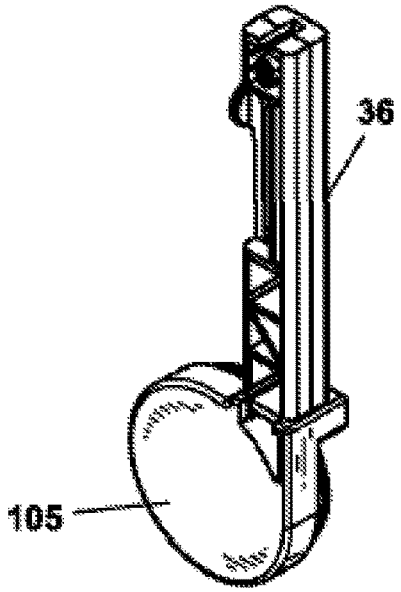
Figure 58:
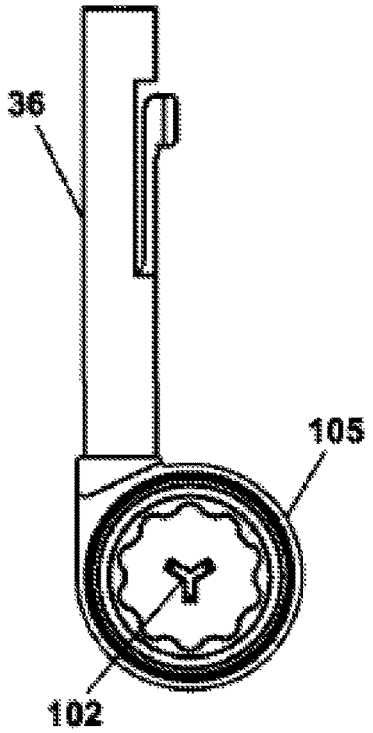
Figure 59:
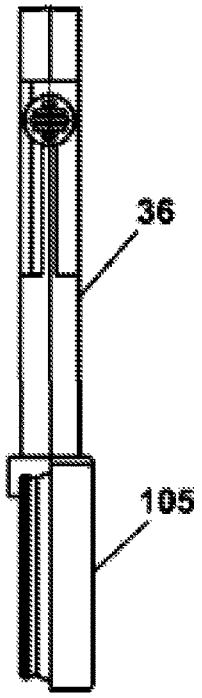
Figure 60:
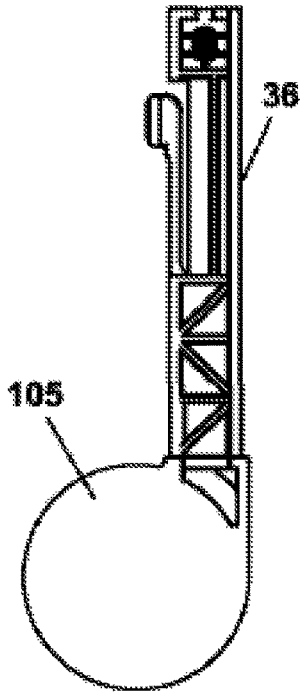

Slots/openings 109, as shown in FIG. 49, facilitate folding of seat bottom 15.

Dimples 110 are artifacts from the injection molding process and may be omitted.

Figure 16:
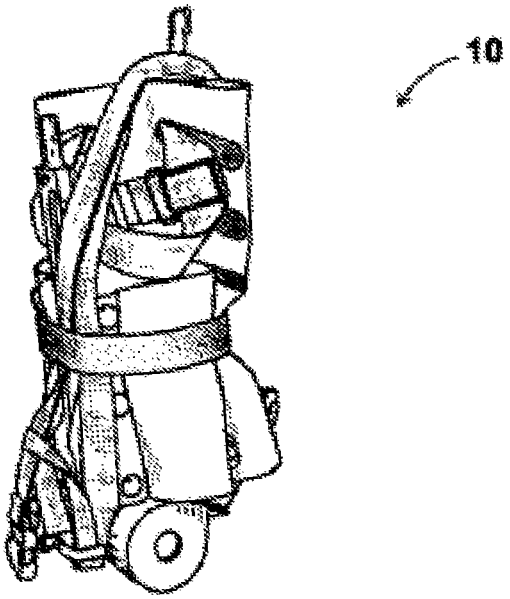
FIG. 16 is a perspective view showing a preferred embodiment of the apparatus of the present invention in a folded position.

The dimensions and materials for various parts can be as follows:

Seat 10—when open and fully extended: about 7.5-45 centimeters high by about 7.5-45 centimeters wide by about 7.5-45 centimeters deep, preferably about 20-40 centimeters high by about 15-36 centimeters wide by about 16-28 centimeters deep, and more preferably about 25-35 centimeters high by about 21-31 centimeters wide by about 18-24 centimeters deep; in a commercial embodiment, it is about 32.5 centimeters high by about 26.5 centimeters wide by about 20 centimeters deep when open and fully extended;

Seat 10—when open and fully retracted:
about 7.5-45 centimeters high by about 7.5-45 centimeters wide by about 7.5-45 centimeters deep,
preferably about 15-35 centimeters high by about 15-36 centimeters wide by about 10-21 centimeters deep, and
more preferably about 20-30 centimeters high by about 21-31 centimeters wide by about 12-18 centimeters deep; in a commercial embodiment, it is about 25 centimeters high by about 26.5 centimeters wide by about 15 centimeters deep when open and fully retracted;

In a commercial embodiment seat 10 is about 29 cm long by about 8 cm high by about 10 cm wide when fully retracted and folded, as shown in FIG. 16.

Seat Back Cover 28—about 2.5-45 centimeters high, preferably about 16-24 centimeters high, and more preferably about 18-22 centimeters high; in a commercial embodiment, it is 20 centimeters high; seat back cover 28 can be made of, for example, neoprene.

Seat Bottom Cover 29—about 5-45 centimeters deep, preferably about 6-16 centimeters deep, and more preferably about 8-12 centimeters deep; in a commercial embodiment, it is about 10 centimeters deep; seat bottom cover 29 can be made of, for example, neoprene.

In a commercial embodiment, the angle between the seat back and the seat base can be adjusted from 0 degrees to 180 degrees, with preset stops at 0 degrees, about 36 degrees, about 72 degrees, about 144 degrees, about 108 degrees, and 180 degrees.

In a commercial embodiment seat back 14 and seat bottom 15 are made out of 0027-005-006-B PP-HO 35 brand homo-polymer polypropylene using melt clarified pellets (but other sufficiently flexible materials can be substituted, such as a similar plastic product); neoprene is used for covers 28, 29, but similar, preferably cushiony, materials could be substituted; mating part 80 and mating part 85 are made of ISOPLAST 101 LGF40 brand engineering thermoplastic resin with 40% long glass fiber available from Lubrizol Advanced Materials, Inc., but other sufficiently strong, stiff, but somewhat flexible material could be used, such as another similar plastic product; button 90, outer pivot section 100, and inner pivot section 105 are made out of ZYTEL 70G33L NC010, supplied by DuPont Performance Polymers, which includes nylon resin with 33% glass fiber, also described as 33% Glass Reinforced Polyamide 66, but another strong, sufficiently stiff, material, such as a similar plastic product, could be used; and spring 98 can be made of metal.

PARTS LIST

The following is a list of parts and materials suitable for use in the present invention:

10 child's folding seat/apparatus
11 frame
12 upper frame section
13 lower frame section
14 seat back
15 seat bottom
16 locking pivot/rotary connector
17 locking pivot/rotary connector
18 slot/opening
19 slot/opening
20 slot/opening
21 peg
22 peg
23 opening/slot
24 storage bag
25 arrow
26 seat harness
27 child harness
28 seat back cover
29 seat bottom cover
30 child/toddler
31 torso
32 shoulder
33 bench
34 upper frame rod/leg
35 upper frame rod/leg
36 lower frame rod/leg
37 lower frame rod/leg

38 center strap
39 connection/fitting
40 strap
41 strap
42 buckle part
43 buckle part
44 buckle part
45 buckle part
46 adjustment fitting
47 adjustment fitting
48 strap
49 strap
50 cross strap
51 cross strap
52 buckle
53 buckle
54 buckle
55 panel
56 panel
57 panel
58 panel
59 panel
60 panel
61 panel
62 panel
63 panel
64 score
65 panel
66 panel
67 panel
68 panel
69 panel
70 panel
71 panel
72 panel
73 panel
74 score
75 loop
76 loop
77 upper locking mechanism
78 lower locking mechanism
79 opening
80 locking member
81 pivot
82 pivot
83 slot
84 pivotal connection
85 locking member
86 pivot
87 opening
88 projection
89 arrow
90 release button
91 socket
92 inner teeth
93 surface
94 projection
95 teeth
96 socket
97 teeth
98 core inner spring
99 teeth
100 outer pivot section
101 opening
102 projection
103 central portion
104 annular portion/projection
105 inner pivot section
106 annular recess
107 legs
108 arrow
109 slot/opening
110 dimple The embodiments shown in the accompanying drawings and described herein are exemplary of numerous embodiments that may be made within the scope of the following claims. It is contemplated that many other configurations may be used, and the material of each component may be selected from numerous materials other than those specifically disclosed. In short, it is the applicant's intention that the scope of the patent issuing herefrom will be limited only by the scope of the appended claims.

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A foldable child's chair, comprising:

a) a frame that includes an upper section and a lower section;

b) means for pivotally joining the upper section to the lower section wherein the upper section is able to rotate into a folded, storage position wherein the folded, storage position, the upper and lower sections are generally aligned;

c) a corrugated seat back that is attached to the upper section, said corrugated seat back including a plurality of panels wherein each panel folds upon another of said panels in the folded, storage position;

d) a seat bottom attached to the lower section;

e) wherein in said storage position some of the panels abut the frame; and f) wherein the seat bottom includes a plurality of panels, wherein each seat bottom panel folds upon another of said seat bottom panels in a storage position.

2. The foldable child's chair of claim 1 wherein each panel is of a plastic, synthetic, wood or metal material.

3. The foldable child's chair of claim 1 wherein the upper section includes spaced apart frame rods and wherein the seat back spans between upper spaced frame rods.

4. The foldable child's chair of claim 1 wherein the lower section includes spaced apart lower frame rods and wherein the seat bottom spans between said lower frame rods.

5. The foldable child's chair of claim 1 wherein a score separates each panel from another panel.

6. The foldable child's chair of claim 5 wherein each score is generally parallel to another score.

7. The foldable child's chair of claim 1 further comprising a first folding strut mounted to the frame upper section next to the seat back that moves between relaxed and extended positions wherein the seat back is fully expanded by the first folding strut when said strut is in the extended position.

8. The foldable child's chair of claim 7 further comprising a second folding strut mounted to the frame lower section next to the seat bottom that moves between relaxed and extended positions wherein the seat bottom is fully expanded by the second folding strut when said second folding strut is in the extended position.

9. A foldable child's chair, comprising:

a) a frame that includes an upper section that includes a pair of upper rods and a lower section that includes a pair of lower rods;

b) first and second pivotal connections that join the upper section to the lower section wherein the upper section is able to rotate into a folded storage position, wherein the upper and lower rods are generally aligned;

c) a seat back that is attached to the upper section;

d) a seat bottom that is attached to the lower section;

e) wherein said seat back includes a first plurality of panels and said seat bottom includes a second plurality of panels, wherein the panels of the first plurality fold upon one or more of said panels of said first plurality, and wherein the panels of the second plurality fold upon one or more of said panels of said second plurality in a storage position; and f) wherein in said storage position the first and second pivotal connections move toward each other, and some of the panels abut the frame.

10. The foldable child's chair of claim 9 wherein the frame upper section includes spaced apart first and second upper rods.

11. The foldable child's chair of claim 10 wherein the seat back attaches to each of said upper rods.

12. The foldable child's chair of claim 10 wherein each of the pivotal connections is lockable in a selected position of multiple positions so that an angle between the upper section and the lower section can be changed to a selected angle.

13. The foldable child's chair of claim 10 further comprising a seat harness that enables a connection to be made between the frame lower section and a selected, underlying bench, chair or seat.

14. The foldable child's chair of claim 10 further comprising safety belts on the frame that enable a child to be restrained while sitting on the seat bottom.

15. The foldable child's chair of claim 10 wherein the seat back has one or more seat back openings and a safety belt passes through one or more of said seat back openings.

16. The foldable child's chair of claim 9 wherein the frame lower section includes spaced apart first and second lower rods.

17. The foldable child's chair of claim 16 wherein the seat bottom attaches to each of said lower rods.

18. The foldable child's chair of claim 16 wherein at least one of the rods includes multiple flat sides and the panels abut multiple of said flat sides in the storage position.

19. A foldable child's chair, comprising:

a) a frame that includes an upper section and a lower section, the upper section having first and second spaced apart upper frame rods and the lower section having first and second spaced apart lower frame rods;

b) first and second pivotal connections that join the upper section to the lower section, wherein the first pivotal connection joins the first upper frame rod to the first lower frame rod, and the second pivotal connection joins the second upper frame rod to the second lower frame rod, wherein the upper section is able to rotate into a folded position wherein the upper and lower sections are generally aligned;

c) a seat back that is attached to the upper section;

d) a seat bottom that is attached to the lower section;

e) the seat back including a first plurality of panels, and the seat bottom including a second plurality of panels, wherein the panels of the first plurality fold upon one or more of said panels of said first plurality, and wherein the panels of the second plurality fold upon one or more of said panels of said second plurality in a storage position;

f) wherein in said storage position some of the panels abut the frame and the pivotal connections move toward one another;

g) each seat back and seat bottom being expandable into an expanded position; and h) foldable and expandable locking members that enable the seat back and seat bottom to be held in the expanded position.

* * * * *